United States Patent [19]

Heinz et al.

[11] 4,451,945

[45] Jun. 5, 1984

[54] MEDICAL COUCH

[75] Inventors: Lothar Heinz, Neunkirchen, Fed. Rep. of Germany; George Menor, Martinez; Hendrick Jahsman, Berkeley, both of Calif.

[73] Assignee: Siemens Medical Laboratories, Inc., Walnut Creek, Calif.

[21] Appl. No.: 299,882

[22] Filed: Sep. 8, 1981

[51] Int. Cl.[3] ..... A61G 7/00

[52] U.S. Cl. ..... 5/63; 5/11

[58] Field of Search ..... 5/60, 63–65, 5/11, 62; 248/421, 544, 588, 651

[56] References Cited

U.S. PATENT DOCUMENTS

| | | | |
|---|---|---|---|
| 346,246 | 8/1886 | Uhde . | |
| 836,397 | 11/1906 | McGough | 5/63 |
| 1,581,994 | 4/1926 | Duncan | 5/66 |
| 2,547,827 | 4/1951 | Logan . | |
| 3,174,722 | 3/1965 | Alm | 5/63 |
| 3,203,670 | 8/1965 | Farris | 5/62 |
| 3,282,566 | 11/1966 | Clarke | 5/63 |
| 3,308,485 | 3/1967 | Nesbit-Evans | 5/63 |
| 3,373,453 | 3/1968 | Goodman | 5/63 |
| 3,414,933 | 12/1968 | Gronbach | 16/180 |
| 3,465,373 | 9/1969 | Wilson | 5/63 |
| 3,611,452 | 10/1971 | Turko et al. . | |
| 3,686,696 | 8/1972 | Lanigan . | |
| 3,733,623 | 5/1973 | Croxton | 5/63 |
| 3,743,344 | 7/1973 | Jameson | 5/63 |
| 3,793,652 | 2/1974 | Linehan . | |
| 3,991,428 | 11/1976 | Hanson | 5/63 |
| 4,071,222 | 1/1978 | Wright | 5/62 |
| 4,173,372 | 11/1979 | Norris | 248/421 |

FOREIGN PATENT DOCUMENTS

| | | | |
|---|---|---|---|
| 1447701 | 2/1974 | France . | |
| 1198892 | 7/1970 | United Kingdom | 5/63 |
| 2095547 | 3/1972 | United Kingdom . | |
| 1468255 | 1/1977 | United Kingdom | 5/63 |

*Primary Examiner*—Alexander Grosz
*Assistant Examiner*—Michael F. Trettel
*Attorney, Agent, or Firm*—Karl F. Milde, Jr.; Max Moskowitz

[57] ABSTRACT

The medical couch contains a lower frame, an upper frame for carrying a table top, and a link mechanism interconnecting both frames. The link mechanism includes pivotally interconnected support arms which are operated in a scissor action to lift and lower the upper frame with respect to the lower frame. An electronic motor drive system containing an electric motor and a lead screw is provided for performing such operation. The drive system is pivotally connected to the lower frame such that the lead screw extends towards the upper frame. The pivoting axis is arranged horizontally. A nut element which is mounted on the lead screw travels therealong when the motor is in operation. The nut element is provided for supporting the link mechanism and pivotally connected therewith. The nut element will be pivoted about an upper horizontal axis when it travels along the lead screw. The nut element moves the upper frame to a selected horizontal position above and parallel to the lower frame.

2 Claims, 11 Drawing Figures

MEDICAL COUCH

BACKGROUND OF THE INVENTION

1. Field of the Invention

This invention relates to a novel and improved medical couch. Particularly, this invention relates to a treatment couch which can be used for treating patients in radiotherapy. Still more particularly, this invention relates to a treatment couch for treating patients with X-rays and/or electrons.

2. Description of the Prior Art

Medical couches and hospital beds that incorporate mechanisms for lifting a patient are well-known in the art.

U.S. Pat. No. 346,246 discloses a medical operating couch having a lower frame and an adjustable upper frame. By turning two threaded rods, the couch top can be raised and lowered horizontally, or it can be adjusted on an incline. —Difficulties must be expected when the couch is raised from a low position since this requires considerable force, and the threaded rods and heads must be dimensioned accordingly.

U.S. Pat. No. 2,547,827 discloses a hospital bed which is vertically adjustable and universally tiltable. In this hospital bed, a motor is used to rotate a horizontally disposed shaft. Also in this design, difficulties in lifting the bed may be expected when the bed is in its lowered position. The lifting range is limited, and the lifting mechanism requires some space.

French Patent No. 1,447,701 discloses a hospital bed the top of which is also adjustable vertically; that is the top will stay in a horizontal position during and after the adjustment. —This lifting mechanism requires a special motor since it is essential that the lead screw moves through the motor. Therefore, a certain depth is needed below the motor. Such requirement is adverse to a compact design of the lifting mechanism. Also, provisions must be made that the lead screw is not positioned vertically, otherwise it would not be possible to lift the couch.

U.S. Pat. No. 3,373,453 discloses a vertically adjustable bed which contains a lower and an upper frame. —In this design, the lifting mechanism including the lower assembly is rather complex, and a large number of parts are required. Also, the maximum height which can be achieved is limited. The cross bars of the lifting mechanism are interconnected by a coil spring. If the coil spring should break, the bed may collapse very quickly. A simple coil spring, therefore, does not provide optimum security.

Other known structures such as shown in U.S. Pat. Nos. 3,611,452, 3,686,696 and 3,793,652 require an unduly and commercially undesireable large number of parts and of space in and beneath the bed to accomodate the lifting mechanism.

SUMMARY OF THE INVENTION

1. Objects

It is an object of this invention to provide a medical couch which is vertically adjustable to small increments of height and which is nevertheless sturdily and ridigly supported in all positions.

It is another object of this invention to provide a vertically adjustable medical couch which is simple in construction, inexpensive to manufacture and easy to operate.

It is still another object of this invention to provide a vertically adjustable medical couch in which the mechanism for the vertical adjustment is of a compact structure.

It is still another object of this invention to provide a vertically adjustable medical couch which can be transformed from a lowered position to a raised position, and vice-versa, without medically undesirable vibrations.

It is still another object of this invention to provide a medical couch which avoids transmission cables between a motor drive and the couch components to be raised or lowered.

It is still another object of this invention to provide a medical couch having a large lifting range.

It is still another object of this invention to provide a medical couch having high stability.

It is still another object of this invention to provide a vertically adjustable couch which is no hazard to a patient lying on the couch when a malfunction of its vertical drive system occurs.

It is still another object of this invention to provide a vertically adjustable medical couch in which an operator (surgeon, nurse) has free access from all sides without meeting difficulties with regard to jutting-out components and parts.

It is still another object of this invention to provide a medical couch having so-called double scissors on each of two sides for obtaining a large lifting range.

It is still another object of this invention to provide a medical couch which can be lifted from a lowered position to a raised position without any starting difficulties.

2. Summary

According to the invention, a lower frame is arranged in a first horizontal plane. An upper frame for carrying a table top is arranged in a second horizontal plane above the first horizontal plane. A scissors link mechanism interconnects the lower frame with the upper frame. This scissors link mechanism is determined for moving the upper frame parallel to the lower frame between a lowered and a raised position, and vice versa. The scissors link mechanism includes at least a first and a second pair of pivotally interconnected supporting arms. The first pair of supporting arms is arranged in a vertical plane between one side of the lower frame and one side of the upper frame, and the second pair of supporting arms is arranged in a vertical plane between the opposite side of the lower frame and the opposite side of the upper frame. Thereby, both pairs of pivotal supporting arms are arranged parallel with respect to each other.

There is also provided an electric motor drive system which contains an electric motor and a threaded lead or rod. The lead rod is rotatable by the motor. It is longitudinally fixed with respect to the drive system. In other words, the lead rod cannot travel through the motor. There is also provided a lower pivoting means for pivotally connecting the drive system to the lower frame and for pivoting the drive system about a stationary horizontal axis. The lead rod extends towards the upper frame. During operation it pivots in a plane which is parallel to the pairs of pivotally supported arms.

A nut element is arranged between the first and the second pairs of supporting arms. The nut element is mounted on the lead rod in order to travel therealong.

An upper pivoting and supporting device is connected to the nut element for pivoting the nut element about an upper horizontal axis and for supporting the scissors link mechanism. In operation the upper horizontal axis is moved parallel to the lower horizontal axis. The upper horizontal axis is arranged elevated above the lower horizontal axis. Thereby, the upper pivoting and supporting device selectively adjusts the elevation of the scissors link mechanism above the lower frame when the motor is in operation and the nut element travels along the threaded rod, thereby moving the upper frame into a selected position.

The foregoing and other objects, features and advantages of the invention will be apparent from the following more particular description of preferred embodiments of the invention, as illustrated in the accompanying drawings.

DETAILED DESCRIPTION OF THE PREFERRED EMBODIMENTS

Figure 1:
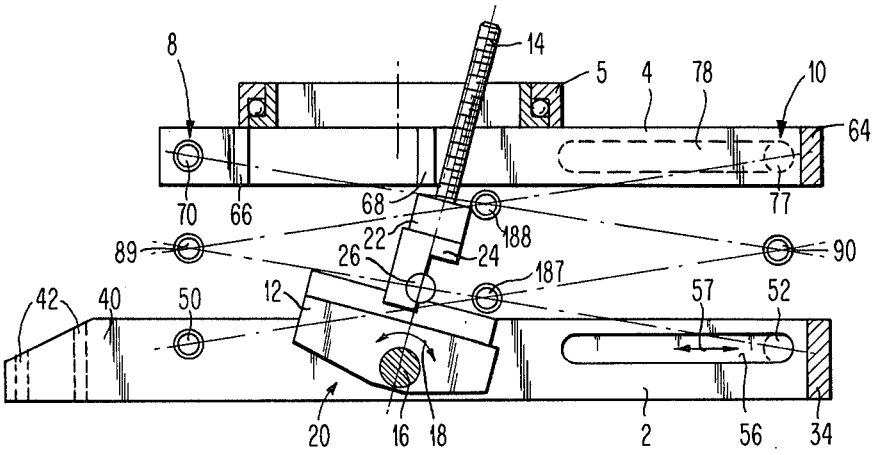
FIG. 1 is a side view showing the essential mechanism of a medical couch according to the invention in its lowered position.
Figure 2:
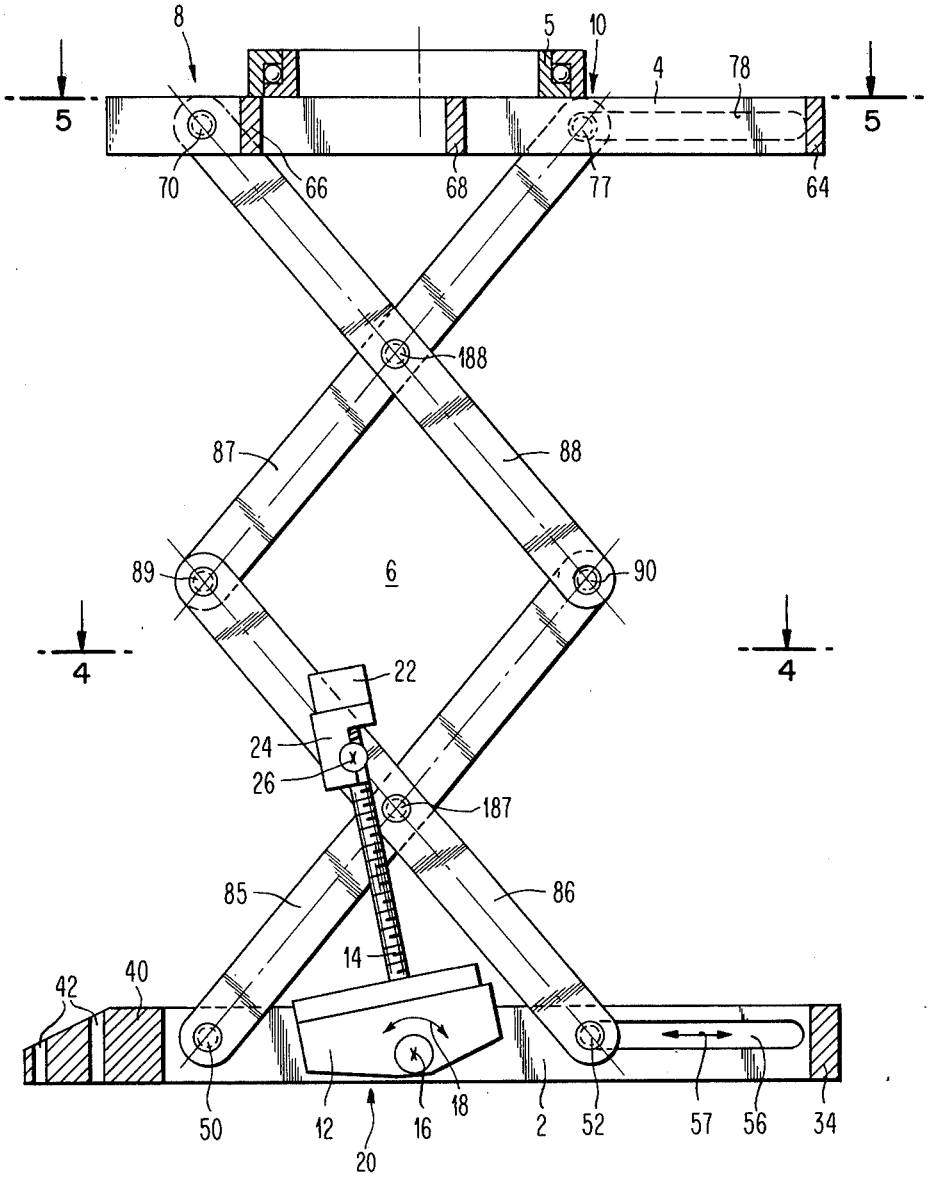
FIG. 2 is a side view showing the mechanism of the medical couch of FIG. 1 in its raised position.

With reference to FIGS. 1 and 2, a medical couch is schematically illustrated in its lowered position and in its raised or elevated position, respectively. FIGS. 1 and 2 afford a side elevational view into the interior of the medical couch. Only the most important parts are schematically shown in FIGS. 1 and 2 in order to depict clearly the operation of the lifting mechanism of the couch. The couch may primarily be used in radiation therapy for irradiation of a patient by electrons and/or X-rays.

A lower frame or support rail assembly which is generally designated as 2 is arranged in a lower horizontal plane. The configuration of the frame 2 is essentially rectangular. Operatively connected to the lower frame 2 is an upper frame which is generally designated as 4. The configuration of this frame 4 is also essentially rectangular. The upper frame 4 is smaller in length, width and thickness than the lower frame 2. It is located directly above the lower frame 2. The frame 4 is arranged in an upper horizontal plane above and parallel to the lower plane. The upper frame 4 is determined for carrying a table top or mattress frame (not shown in FIGS. 1 and 2) on which the patient may rest for treatment. A rotation ring 5 is supported by the upper frame 4. This ring 5 may carry a device (not shown) for performing longitudinal motions. This device in turn may carry the table top. The outer part of the rotation ring 5 can be rotated about a vertical axis. Therefore, the ring 5 may be termed treatment table rotation base.

A pivotal interconnecting support arm link mechanism interconnects the lower frame 2 and the upper frame 4. The scissors link mechanism is generally designated by reference numeral 6. This mechanism serves to move the upper frame 4 parallel to the lower frame 2 between a lowest horizontal position and a highest horizontal position, and vice versa. All intermediate positions can be taken. As will be explained in more detail later, the link mechanism 6 includes a first and a second pair of multiple pivotably interconnected support arms. The first and second pairs of link mechanisms are connected to opposite sides of the frames 3 and 4. Both are positioned vertically. Each pair of double link mechanisms consists to two pairs of acting links or arms. In other words, the link mechanism includes two sets of four interconnecting links or arms. In FIGS. 1 and 2, only the rear pair of double link mechanisms can be seen.

The double link mechanisms have two fixed left end portions which are pivotly connected to the frames 2 and 4, and two right end portions 10 which are pivotly and slideably connected to the frames 2 and 4, as will be come apparent later.

The medical couch further contains an electric motor drive system 12. This drive system 12 preferably includes an electric motor and a gear system (see FIG. 7). The drive system 12 rotates a threaded lead rod or screw 14 which is fixed in its longitudinal direction. The lead screw 14 extends upwardly from the drive system in an oblique direction. It is arranged in a plane approximately halfway between the two vertical double link mechanisms.

Figure 3:
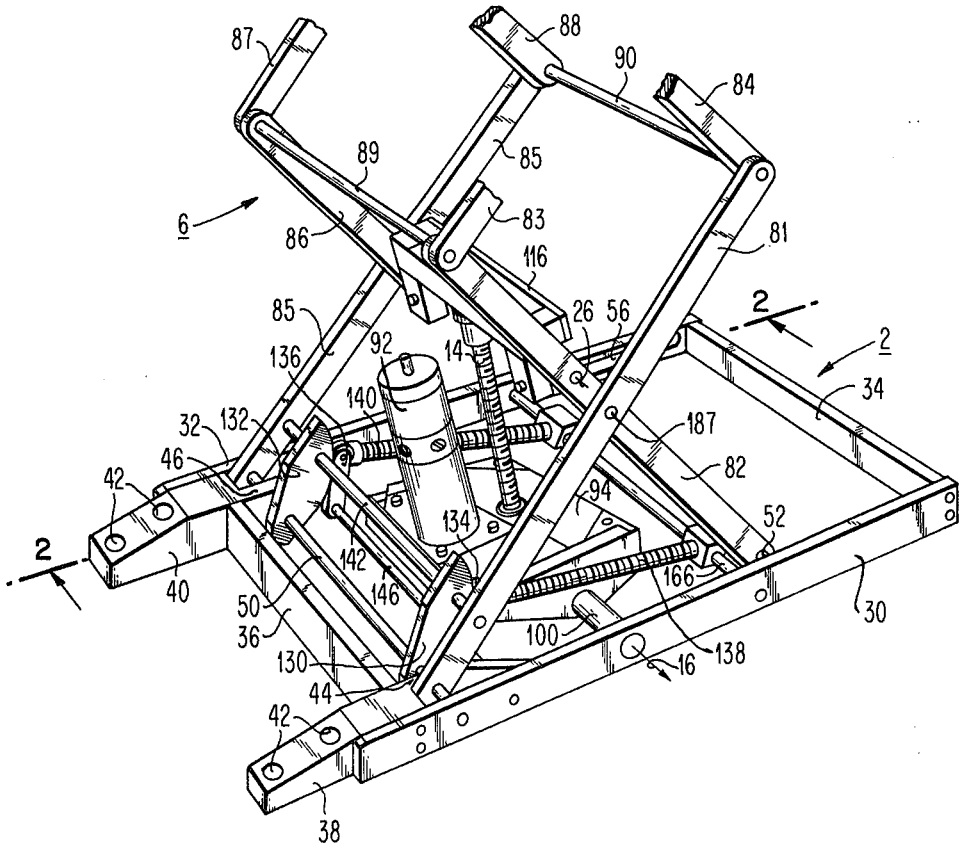
FIG. 3 is a perspective view of a preferred embodiment of the mechanism for a medical couch according to the invention.
Figure 6:
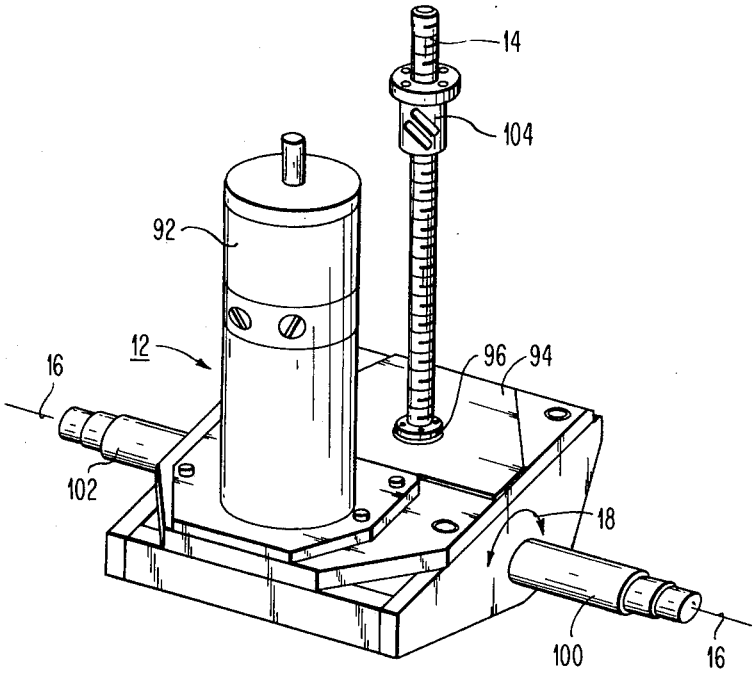
FIG. 6 is a perspective view of the electric motor drive system and its pivoting device of the mechanism illustrated in FIG. 3.

The drive system 12 is supported by and pivotly connected to the lower frame 2 by means of a pivoting device, as shown in FIGS. 3 and 6. This pivoting device may be of any design. Due to the pivoting device, the drive system 12 may be pivoted about a stationary horizontal axis 16. This is indicated in FIGS. 1 and 2 by a double arrow 18. The horizontal axis 16 is thus positioned perpendicularly to the planes of the double link mechanisms.

By comparing FIGS. 1 and 2, it will be noted that (at 20) the motor system 12 does not occupy and thus leaves free the space below the lower frame 2 even when the motor system 12 is rotated about the stationary horizontal axis 16 from one side to the other. Therefore, the lower frame 2 can be positioned directly on the floor of a hospital. It can also be mounted on low casters close to the floor.

A nut element 22, particularly a ball nut, is mounted on the lead screw 14 for travelling therealong. That is, the thread of the nut element 22 is complementary to that of the lead screw 14. The lead screw 14 and the nut element 22 are arranged in the space between the two pairs of double link mechanisms.

Of importance to a fault-free lifting operation of the medical couch is an upper pivoting and supporting device or lift assembly 24. This device 24 is pivotly connected to and combined with the nut element 22. It supports and moves the link mechanism 6. It will be noted that the link mechanism 6 is supported at the fixed end portion 8 by the lower frame 2, at the slideable end portion 10 also by the lower frame 2, and at the nut element 22 by the lift assembly 24.

As can be seen in FIGS. 1 and 2, the pivoting and supporting device 24 is pivotly connected to the lower link mechanism in an upper horizontal axis 26 which is located above and parallel to the lower horizontal axis 16. In operation, the upper horizontal axis 26 is moved parallel to the stationary lower axis 16 and therefore parallel to the plane of the lower frame 2. It shall be emphasized that the upper horizontal axis 26 is a movable axis, whereas the lower horizontal axis 16 is a stationary axis. In particular, the upper axis 26 is arranged such that it is on the fixed end portion 8 when the couch is in its collapsed position (FIG. 1). The upper horizontal axis 26 may be formed by a pin which rotates in a hole located in the corresponding lower scissors link. As illustrated, this hole may be located above the crossing point at about 0.6 the total length of the link. The crossing point of the lower scissors is located preferable at approximately 0.5 the total length of the crossing links.

When the motor system 12 is in operation in order to lift the medical couch, the lead screw 12 is rotated such that the ball nut 22 travels axially along the lead screw 14 from its lowest position (see FIG. 1) to its highest position (see FIG. 2). The drive force is transmitted to the link mechanism 6 through the pivoting and supporting device 24 including the nut element 22. This causes the lower link on the fixed end portion 8 to rotate and the lower link on the sliding end portion 10 to travel horizontally along a groove from right to left. Thereby, the crossing angle between the crossing links of each pair of link mechanisms is varied. The ball nut 22 follows the horizontal motion of the upper horizontal axis 26 by pivoting about the lower horizontal axis 16 with the lead screw 14 and the drive system 12. The upper frame 6 is moved thereby into a selected position. It will be noted from FIGS. 1 and 2 that the lead screw 14 will be pivoted through its vertical position when the couch is raised from its completely collapsed position to its highest position.

Figure 4:
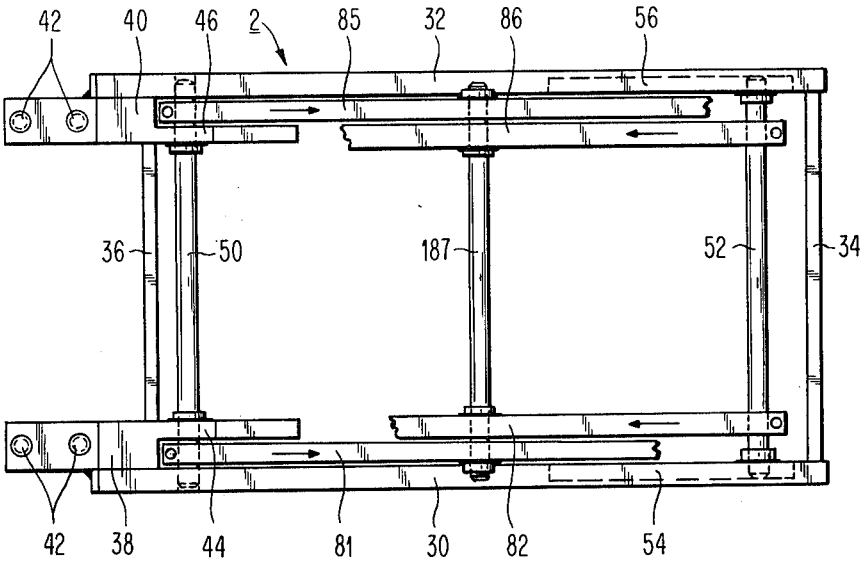
FIG. 4 is a top plan or view of the lower part of the medical couch of FIG. 3.

In FIGS. 3 and 4 details of the lower rectangular frame 2 are illustrated. The lower frame 2 essentially consists of two longitudinal side walls 30 and 32, two transverse side walls 34 and 36, and two end shoes 38 and 40 arranged between the ends of the transverse side wall 36 and the ends of the sidewalls 30 and 32, respectively. The side walls 30, 32, 34 and 36 may preferably consist of solid steel. They are all of rectangular cross-section. The side walls 30–36 and the end shoes 38 and 40 are welded together to form a rigid assembly of essentially rectangular shape. The end shoes 38 and 40 are provides with holes 42 for securing the lower frame 2 to the floor or to a platform (not shown). The end shoes 38 and 40 are also provided with protrusions 44 and 46, respectively, which extend into the interior of the lower frame 2 such as to form two small jaws with the walls 30,32.

A first transverse shaft or bar 50 horizontally projects through both jaws. The bar 50 is secured therein. This bar 50 which is used as a pivoting axis represents the lower part of the fixed end portion 8 of the link mechanism 6. The lower part of the sliding end portion 10 is represented by a second transverse bar 52 which is arranged parallel to the first transverse bar 50. The second bar 52 is also used as a pivoting axis. The ends of the second transverse bar 52 slide in channels or grooves 54 and 56, respectively. These grooves 54 and 56 are arranged horizontally in the inner surfaces of the right side of the longitudinal walls 30 and 32, respectively. The two ends of the bar 52 may be provided with rollers (not shown) for an easy travel in the inner grooves 54 and 56. The horizontal sliding motion is indicated in FIGS. 1 and 2 by a double arrow 57.

Figure 5:
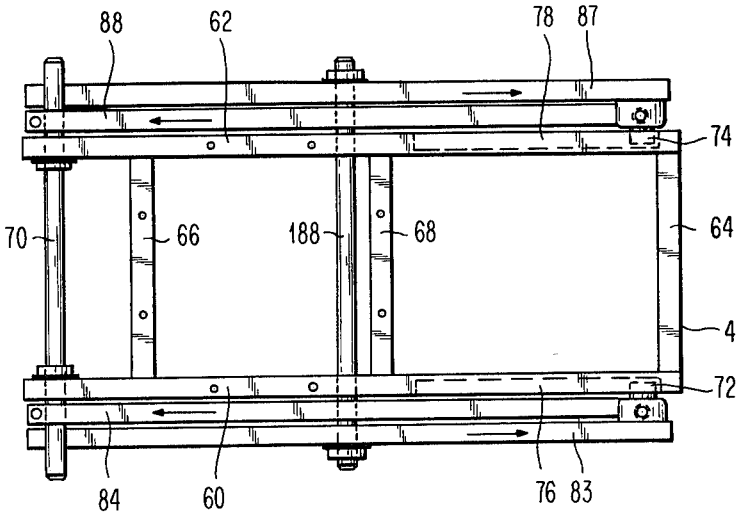
FIG. 5 is a top plan or view of the upper part of the medical couch of FIG. 3.

Details of the upper frame 4 are illustrated in FIG. 5. The upper frame 4 is smaller than the lower frame 2. It contains two longitudinal side walls 60 and 62, which are positioned parallel to each other, and three transverse side walls 64, 66 and 68, which are also positioned parallel to each other. All side walls 60-68 are made of solid steel. Preferably, they have a rectangular cross-section. They are welded together such as to form a rectangular wall assembly. Whereas the side wall 64 is connected to the right ends of the longitudinal side walls 60 and 62, the side walls 66 and 68 interconnect the longitudinal side walls 60 and 62 at their left end section and their middle section, respectively.

A third transverse shaft or bar 70 projects through the left ends of the side walls 60 and 62. This third bar 70 is a pivoting axis. It represents the upper part of the fixed end portion 8 of the link mechanism 6. The upper part of the sliding end portion 10 is represented by two transverse pins 72 and 74 which are axially aligned and which are arranged parallel to the third bar 70. The ends of these pins 64 and 66 facing each other slide in channels or grooves 76 and 78, respectively. The grooves 76 and 78 are arranged horizontally in the outer surfaces of the longitudinal walls 60 and 62, respectively, on their right side. The inner ends of the pins 72 and 74 may be provided with rollers (not shown) for an easy ride in the outer grooves 76 and 78, respectively.

As can be seen in FIGS. 4 and 5 and also partially in FIG. 3, the scissors link mechanism 6 includes four bars, links or arms 81, 82, 83 and 84 in double link arrangement, and another four bars, links or arms 85, 86, 87 and 88, also in double link arrangement. Both double link arrangements are positioned parallel to each other and vertically on the lower frame 2.

The links 81 and 85 are the outer links of the two lower pairs of pivotal arms, and the links 83 and 87 are the outer links of the two upper pairs of pivotal arms. The links 81, 82, 85, 86 all have the same length, and the links 83, 84, 87 and 88 also have the same length, which may be different from the length of the other links. Yet, preferably, all links 81–88 may have the same length. In FIGS. 4 and 5, arrows indicate in which direction the individual links 81–88 are elevated. As can be seen in FIGS. 2 and 3, the links of the pairs 81, 83 and 82, 84 and 85, 87 and 86, 88 are parallel to each other. In FIG. 5, link 87 has to be assumed to be parallel above link 85, and link 88 has to be assumed to be parallel above link 86.

Both double link arrangements are secured and pivotly connected to each other by two connection members, rods or bars 87 and 88. These connection bars 87 and 88 connect both lower and upper crossing points, respectively, with each other. Further, both double link arrangements are secured and pivotly connected to each other by two additional transverse members or bars 89 and 90, as can best be seen in FIG. 3. The first additional bar 89 pivotly connects the upper end of the link 82 to the lower end of the link 83. It also pivotly connects the upper end of the link 86 to the lower end of the link 87. The second additional bar 90 pivotly connects the upper end of the link 81 to the lower end of the link 84. It also pivotly connects the upper end of the link 85 to the lower end of the link 88. In short, the bars 89 and 90 pivotly connect adjacent ends of the two double links. The transverse bars 87–90 are all parallel to each other and parallel to the In FIGS. 3 and 6, details of the electric motor drive system 12 are illustrated. This drive system 12 contains an electric motor 92 and a gear system 94 operatively connected to the motor 92. The lead screw 14 extends upward from the box of the gear system. The lead screw 14 is longitudinally fixed to the box of the gear system 94 by a ring 96 which is secured thereto by screws. It should be pointed out that also two lead screws or a multiple screw system having three or more lead screws may be applied.

The drive system 12 may pivot about the lower horizontal axis 16, as indicated above. For this purpose, a lower pivoting device is provided. This device is made up of horizontal pins 100 and 102 which extend from two opposite sides of the electric motor drive system 12. The pins 100 and 102 have outer ends the diameter of which is smaller than the diameter of their middle section. As can be seen in FIG. 3, there are provided holes in the middle section of the side walls 30 and 32, for receiving the outer ends of the pins 100 and 102, respectively. Thus, the lead screw 14 may be tilted about the lower horizontal axis 16.

As can be seen in FIG. 6, a ball nut 104 is threadedly received on the lead screw 14. When the lead screw 14 is rotated, the ball nut 104 travels along the longitudinal axis. The ball nut 104 consists of a cylindrical lower part of smaller diameter and a cylindrical upper part of greater diameter. The upper part contains four holes, three of which can be seen in FIG. 6, for securing the ball nut 104 to the upper pivoting and supporting device 24.

Figure 7:
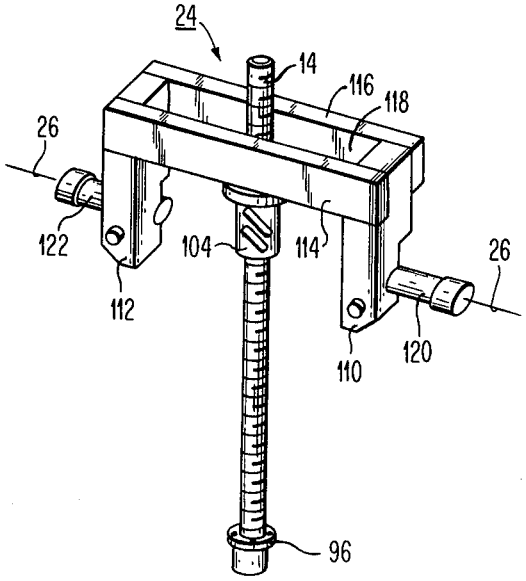
FIG. 7 is a perspective view of the upper pivoting and supporting device of the mechanism illustrated in FIG. 3.

An embodiment of the upper pivoting and supporting device 24 is shown in FIG. 7. This device 24 is essentially formed by a U-shaped yoke. The yoke consists of two parallel side arms or side stand-offs 110 and 112 and two bars 114 and 116 parallel to each other. The bars 114 and 116 connect the upper side of the stand-offs 110 and 112 with each other such that a free space 118 is formed in between. The bars 114 and 116 may be welded to the stand-offs 110 and 112. The cylindrical upper part of the ball nut 104 is connected from below to the middle section of both transverse bars 114 and 116. For this purpose, the four aforementioned holes in the cylindrical upper part (see FIG. 6) are provided. Two of the holes serve to connect the cylindrical upper part to the lower surface of the bar 114, and the other two holes serve to connect the cylindrical upper part to the lower surface of the bar 116. The lead screw 14 thus extends into and through the free space 118.

As mentioned earlier, the device 24 may be pivoted about the upper horizontal axis 26. For this purpose two pivots 120 and 122 are provided which are axially aligned. The pivots 120 and 122 are connected horizontally to the stand-offs 110 and 112, respectively, extending therefrom. The connection is made by means of bolts. As can be seen in FIG. 3, two bores or holes are provided in the inner links 82 and 86, respectively, for pivotly receiving the pivots 120 and 122, respectively. These holes are located above the holes containing the transverse lower bar 87.

As illustrated in FIG. 3, the device 24 supports the link mechanism 6 in the axis 26 which is located a little distance above the axis of the transverse bar 87. However, it is also possible to use the axis of the transverse crossing bar as the upper moveable axis 26. In such a design, the yoke-pivot-combination of FIG. 7 would pivotly interconnect the crossing points of the two lower scissors 81, 82 and 85, 86. Such design would only be a little less favorable as the design illustrated in FIG. 3.

When the motor 92 is energized and the ball nut 104 travels along the lead screw 14, the pins 120 and 122 will either lift or lower the link assembly 6, depending on the direction of rotation. Thereby, the combination of the drive system 12 and the lead screw 14 will be pivoted about the lower horizontal axis 16. As can be seen in FIG. 3, the lower pivoting axis 16 is arranged parallel to the longitudinal axis of the connecting bar 87. When the couch is raised or lowered, the lead screw 14 will be moved in a plane which is located between the two double link arrangements.

FIG. 3 illustrates that a spring security device is provided for preventing a sudden return of the couch from a raised position to its collapsed position. The security system is based on the idea to store energy in springs when the couch is brought into a lower position. Details of the security system are illustrated in FIGS. 3, 8, 9 and 10. This system makes sure that the couch is no hazard to a patient in the case that the electrical power supplying the motor 92 fails, or that an individual spring breaks.

As can be seen in FIG. 3, the security system essentially contains two parallel cams 130 and 132, two parallel cam followers 134 and 136, and two spring systems 138 and 140, which are also arranged parallel to each other. Both spring systems 138, 140 work parallel to each other. They are actuated by the cam followers 134 and 136, respectively, which in turn are actuated by the cams 130 and 132, respectively. Therefore, two identical partial systems are applied. Both cams 130 and 132 are commonly activated by the link mechanism 6.

Figure 8:
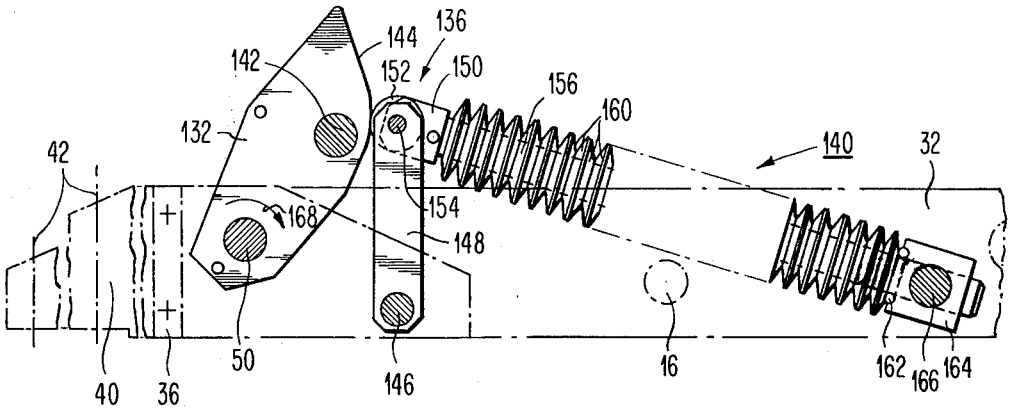
FIG. 8 is a side view of the spring security system used in the medical couch mechanism of FIG. 3.

As illustrated in FIG. 8, the cam 132 of the rear partial system has the shape of an elongated disc. It is kept in a vertical position between the double link mechanism arrangements by means of the bar 50 and an additional transverse bar 142 connecting the links 81 and 85 above the bar 50. Thus, the cam 132 may rotate along with the links 81 and 85 about the axis of the bar 50. The cam 132 is positioned close to the jaw containing the lower end of the link 85. Similarly, the cam 130 which is also supported by the bars 50 and 142, is positioned close to the jaw containing the lower end of the link 81.

The cam 132 has a concave cam surface 144 which is directed to the interior of the link arrangement 6. The same applies to the cam surface of the cam 130.

As shown in FIG. 3, both cams 130 and 132 are pivotly arranged on the bar 50 on opposite sides thereof. They are guided by the additional bar 142. When the links 81 and 85 are rotated about the axis of the bar 50, the cams 130 and 132 are simultaneously rotated about this axis. The cam followers 134 and 136 will firmly engage the cam surfaces of the cams 130 and 132 and follow their shape. The cam followers 134 and 136 are pivotly mounted on a small transverse shaft 146. The shaft 146 connects the frame 30 with the frame 32. It is arranged parallel to the bar 50.

As shown in FIG. 8, the cam follower 136 comprises an arm or lever 148 which is rotatable about the shaft 146, a cam holder or roller yoke 150, and a roller 152 contained therein by means of a pin 154. The cam holder 150 is secured on the first end of a gliding shaft or guiding rod 156 which is part of the spring system 140.

The spring system 140 contains a great number of individual saucer-shaped springs or spring washers 160. These spring washers 160 are faced cup to cup to form an elongated spring. The spring washers 160 may preferably be Bellevelle spring washers. The illustrated spring system has the advantage that it can store much force in a small space. The individual spring washers 160 are slideable arranged on the guiding rod 156.

On the second end of the guiding rod 156 is arranged a sliding ring 162. This sliding ring 162 is attached to a head 164 which has the form of a cube. The head 164 is rotatable mounted on a horizontal shaft 166 which extends from side wall 30 to side wall 32 close to the pins 52 and 54. The cube head 164 has a bore or hole therethrough, thereby forming a container. The bore extends parallel to the link arrangement. The guiding rod 156 is mounted such that it slideable passes through the head 164, as can be see in FIG. 8.

When the couch is lowered, for instance by energizing the motor 92, the spring system 140 will be compressed. This is performed in the following way: The cam 132 will rotate clockwise about the axis 50 as indicated by the arrow 168 (FIG. 8). The roller 152 of the cam follower 136 follows the cam surface 144 which will be pressed firmly thereto. Thereby it is pushed to the right side in FIG. 8. The cam holder 150 will exercise some pressure on the spring washers 160 which cannot retreat to the right side. They are longitudinally fixed by the ring 162 and the head 164. When the cam holder 150 is pushed to the right side, the guiding rod 156 will slide through the spring washers 160 and through the bore of the cube head 164, thereby extending more and more through the hole. The spring washers 160 which are held between the cam holder 150 and the ring 162 will be compressed in the course of this motion.

It should be understood that the front cam follower 134 has the same design as the rear cam follower 136 illustrated in FIG. 8.

The cam surface 144 may have a shape such that when the couch is lowered, the two spring systems 138 and 140 will be compressed uniformly. This controls the force of the motor 92 in a difinite way. Therefore, the lifting and the decreasing of the couch can be performed uniformly. The illustrated design contributes to a low noise level when the couch is operated. If any of the spring washers 160 should break, that would not mean a disaster. The couch will only sink down slowly. The shaft 156 cannot break during normal operation. Since its free end is gliding in the cube head 164, it is not exposed to strain and stress when the couch is raised or lowered.

Figure 9:
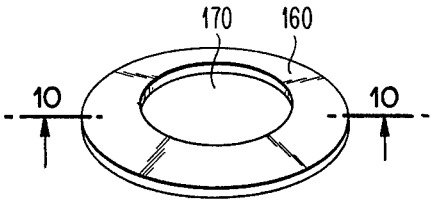
FIG. 9 is a perspective view of a spring washer used in the security system of FIG. 8.
Figure 10:
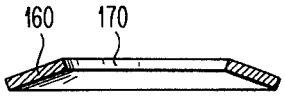
FIG. 10 is a cross-sectional view through 10—10 of the spring washer used in the security system of FIG. 8.

In FIG. 9, a single spring washer 160 is illustrated in a perspective view. It can be seen that the spring washer 160 has a concave shape. In FIG. 10 is illustrated the corresponding cross-section of the spring washer 160. The hole which receives the guiding rod 156 is denoted as 170.

Figure 11:
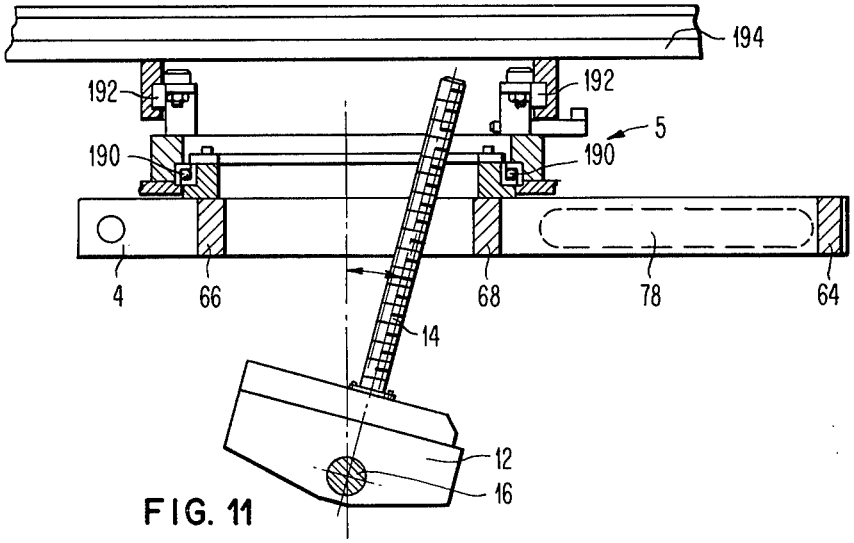
FIG. 11 is a cross-sectional view of the medical couch mechanism of FIG. 3 provided with a rotatable table top.

In FIG. 11 a sectional side view of the upper frame 4 is illustrated. It can be seen that the ring 5 is made up of a smaller inner ring and a greater outer ring. Both rings are connected to each other by juxtaposition of a bearing 190. The outer ring supports a rail system 192 which allows for a longitudinal translation of a table top 194. Rail systems 192 of this nature are well known in the art.

The medical couch illustrated in FIGS. 3 through 11 thus is vertically moveable between a lowered position and a raised position, and vice versa. The upper frame of the couch, which carries the patient, is adjustable in various horizontal positions. The couch has a compact structure. An operator (surgeon, nurse) has free access from all sides to the patient without meeting any difficulties with regard to parts and components sticking out of the scissors assembly. When positioned on a rotable base, the medical couch can easily be rotated about a vertical axis by 180°.

Due to the illustrated construction principles, there are no operational difficulties in starting the couch from the lower position to a higher position. This is true even for heavy patients. There is no need for having unreasonably big dimensions of the components and parts. It is also very easy to transfer the medical couch from one position to the other. That can be done without any vibrations. One power-operated drive system is sufficient for both double link mechanisms.

Of great importance is the face that the medical couch does not imply any hazard to a patient if a malfunction of the drive system occurs. In other words, there will be no sudden return from an elevated position into the collapsed position if the drive system should be out of order. Due to the spring system, the security is always maintained.

While the forms of the medical couch herein described constitute preferred embodiments of the invention, it is to be understood that the invention is not limited to these precise forms of assembly, and that a variety of changes may be made therein without departing from the scope of the invention.

What is claimed is:

1. A medical couch comprising in combination:

(a) a lower frame arranged in a first horizontal plane;

(b) an upper frame for carrying a table top, said upper frame being arranged in a second horizontal plane above said first horizontal plane;

(c) a pivotally interconnected scissor action link mechanism interconnecting said lower frame with said upper frame for moving said upper frame parallel to said lower frame between a lowered and a raised position, and vice versa, said link mechanism including at least a first and a second pair of pivotally interconnected support arms, said first pair of support arms being vertically arranged between one side of said lower frame and one side of said upper frame, and said second pair of support arms being vertically arranged between the opposite sides of said lower and upper frames, each of said first and second pairs of support arms including a circular opening in links of said support arms;

(d) an electric motor drive system containing an electric motor and a lead screw, said lead screw being rotatable by said motor and being longitudinally fixed with respect to said drive system;

(e) lower pivoting means for pivotally connecting said drive system to said lower frame and for pivoting said drive system about a stationary horizontal axis, said lead screw thereby extending towards said upper frame and pivoting in a plane which is parallel to said pivotal support arms;

(f) a ball nut element which is threadedly received on said lead screw for moving therealong when said lead screw is rotated by said motor, said nut element being arranged between said first and said second pairs of support arms, said nut element being mounted on said lead screw for travelling therealong; and (g) upper pivoting and supporting means connected to said nut element for pivoting said nut element about an upper horizontal axis and for supporting said link mechanism, said upper horizontal axis being movable parallel to and being arranged elevated above said lower horizontal axis, such that said upper pivoting and supporting means selectively adjusts the elevation of said link mechanism above said lower frame when said motor is in operation and said nut element travels along said lead screw, thereby moving said upper frame to a selected position, said upper pivoting and supporting means further comprising a horizontal pivot at each of two corresponding sides, each of said pivots being rotatable in a respective one of said openings, said upper pivoting and supporting means also comprising a U-shaped yoke, said yoke having two parallel side stand-offs and two parallel bars interconnecting said stand-offs, said bars forming a free space in between, said ball nut being attached to said interconnecting bars such that said lead screw extends into said free space, and said pivots being connected to said side stand-offs for pivoting said ball nut about said upper horizontal axis.

2. A medical couch comprising in combination:

(a) a lower frame arranged in a first horizontal plane;

(b) an upper frame for carrying a table top, said upper frame being arranged in a second horizontal plane above said first horizontal plane;

(c) a pivotally interconnected scissor action link mechanism interconnecting said lower frame with said upper frame for moving said upper frame parallel to said lower frame between a lowered and a raised position, and vice versa, said link mechanism including at least a first and a second pair of pivotally interconnected support arms, said first pair of support arms being vertically arranged between one side of said lower frame and one side of said upper frame, and said second pair of support arms being vertically arranged between the opposite sides of said lower and upper frames, each of said first and said second pairs of support arms including a circular opening in links of said support arms, said first and second pair of support arms being connected to each other by at least one transverse bar which passes through the crossing point of the links of said two pairs of pivotal support arm, said transverse bar being positioned below said openings, said transverse bar determines in each link of said pivotal support arms two link parts of equal size, said openings being located about 0.6 the total length of said links, said total length being measured along the links from the lower to the higher end thereof;

(d) an electric motor drive system containing an electric motor and a lead screw, said lead screw being rotatable by said motor and being longitudinally fixed with respect to said drive system;

(e) lower pivoting means for pivotally connecting said drive system to said lower frame and for pivoting said drive system about a stationary horizontal axis, said lead screw thereby extending towards said upper frame and pivoting in a plane which is parallel to said pivotal support arms;

(f) a ball nut element arranged between said first and said second pairs of support arms, said nut element being mounted on said lead screw for travelling therealong; and (g) upper pivoting and supporting means connected to said nut element for pivoting said nut element about an upper horizontal axis and for supporting said link mechanism, said upper horizontal axis being movable parallel to and being arranged elevated above said lower horizontal axis, such that said upper pivoting and supporting means selectively adjusts the elevation of said link mechanism above said lower frame when said motor is in operation and said nut element travels along said lead screw, thereby moving said upper frame to a selected position, said upper pivoting and supporting means further comprising a horizontal pivot at each of two corresponding sides, each of said pivots being rotatable in a respective one of said openings.

* * * * *